US007047586B2

(12) United States Patent
Shimada et al.

(10) Patent No.: US 7,047,586 B2
(45) Date of Patent: May 23, 2006

(54) CLEANING DEVICE WITH A CLEANING PORTION COMPRISING AN ADHESIVE SURFACE AND A CLEANING CLOTH SURFACE

(75) Inventors: Hiroshi Shimada, Tokyo (JP); Tomohiro Ohki, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 202 days.

(21) Appl. No.: 10/433,167

(22) PCT Filed: Nov. 16, 2001

(86) PCT No.: PCT/US01/43514

§ 371 (c)(1),
(2), (4) Date: May 30, 2003

(87) PCT Pub. No.: WO02/43555

PCT Pub. Date: Jun. 6, 2002

(65) Prior Publication Data

US 2004/0025271 A1 Feb. 12, 2004

(30) Foreign Application Priority Data

Nov. 30, 2000 (JP) ..... 2000-365737

(51) Int. Cl.
*A47L 13/12* (2006.01)
*A47L 25/00* (2006.01)

(52) U.S. Cl. ..... 15/104.002; 15/105; 15/118; 15/228

(58) Field of Classification Search ..... 15/104.002, 15/118, 105, 228, 229.6, 143.1, 144.1
See application file for complete search history.

(56) References Cited

U.S. PATENT DOCUMENTS

| | | | | |
|---|---|---|---|---|
| 3,656,202 A | | 4/1972 | Paton | |
| 4,349,933 A | | 9/1982 | Thompson | |
| 5,280,664 A | * | 1/1994 | Lin | 15/247 |
| 5,596,787 A | * | 1/1997 | Stevens et al. | 15/220.1 |

FOREIGN PATENT DOCUMENTS

| | | |
|---|---|---|
| GB | 2 233 882 A | 1/1991 |
| JP | 9-164110 | 6/1997 |
| JP | 9-173261 | 7/1997 |
| JP | 10-290770 | 11/1998 |
| JP | 11-128156 | 5/1999 |
| JP | 11-137503 | 5/1999 |
| WO | WO 00/27271 | 5/2000 |

* cited by examiner

*Primary Examiner*—Gladys J. P. Corcoran
*Assistant Examiner*—Laura C Guidotti
(74) *Attorney, Agent, or Firm*—Trisha D. Adamson

(57) ABSTRACT

In a cleaning device (9) comprising a cleaning portion (10) having a cleaning surface (13) and an opposing surface opposite the cleaning surface (13), a support arm (11) having a handle portion (16), and a pivot (12) for pivotally supporting the support arm (11) on the opposing surface, the cleaning surface (13) of the cleaning portion (16) comprises an adhesive surface (17) and a cleaning cloth surface (18), and wherein the adhesive surface (17) and the cleaning cloth surface (18) can individually come into surface contact with a surface to be cleaned, and a stopper (19) for restricting movement of the handle portion (16) relative to the pivot (12), wherein the cleaning cloth surface (18) can contact wherein the surface to be cleaned when the support arm (11) is tilted within a predetermined angle range relative to the surface having the pivot (12), and the adhesive surface (17) can contact the surface to be cleaned when the support arm (11) is tilted beyond the predetermined angle range relative to the surface having the pivot (12).

7 Claims, 4 Drawing Sheets

CLEANING DEVICE WITH A CLEANING PORTION COMPRISING AN ADHESIVE SURFACE AND A CLEANING CLOTH SURFACE

TECHNICAL FIELD

This invention relates to a cleaning device for cleaning surfaces to be cleaned, for example a floor surface such as a flooring, a plastic tile, and a tatami mat inside a building and the like, surfaces of furniture, and so forth. More particularly, this invention relates to a cleaning device capable of removing dust, sand, and the like having sizes exceeding a predetermined size that have been difficult to remove by using conventional cleaning methods.

BACKGROUND OF THE INVENTION

An example of a conventional cleaning device is shown in FIG. 1. This cleaning device 1 includes a cleaning cloth 6 such as a non-woven fabric cloth that is wound on the surface of a holding sheet 2 and is fixed by fixing members 5 such as screws to a surface 4 opposite a cleaning surface 3. A support arm 7 is fitted to the surface 4 of the holding plate 2 through pivot 8 for pivotally supporting it relative to the holding plate 2. Therefore, even when the angle of the support arm 7 changes, the cleaning surface 3 of the cleaning cloth 6 always keeps contact with the surface to be cleaned. When the support arm 7 is moved back and forth, dust and the like is entrapped between the fibers of the cleaning cloth 6 and are thus removed from the surface to be cleaned.

In such a cleaning device according to the prior art, however, the size of dust entrapped between the fibers of the cleaning cloth is limited, and dust and sand having sizes exceeding a predetermined size cannot be removed from the surface to be cleaned using the cleaning device. The present invention is directed to solving such a problem, and to providing a cleaning device capable of reliably removing not only small dust but also dust and sand having sizes exceeding a predetermined size from the surface to be cleaned.

SUMMARY OF THE INVENTION

In certain aspects of the present invention, a cleaning device is provided comprising a cleaning portion having a cleaning surface and an opposing surface opposite the cleaning surface, a support arm having a handle portion, a pivot for affixing the support arm on the opposing surface, wherein the cleaning surface of the cleaning portion comprises an adhesive surface and a cleaning cloth surface, and wherein the adhesive surface and the cleaning cloth surface can individually come into surface contact with a surface to be cleaned. The cleaning device may also include a stopper for restricting movement of the handle portion relative to the pivot. The cleaning cloth surface can contact the surface to be cleaned when the support arm is tilted within a predetermined angle relative to the surface having the pivot, and the adhesive surface can contact the surface to be cleaned when the support arm is tilted beyond the predetermined angle relative to the surface having the pivot.

In the cleaning device according to the present invention, the cleaning surface of the cleaning portion comprises the adhesive surface and the cleaning cloth surface. The cleaning device is generally used while the cleaning cloth surface is brought into surface contact with the surface to be cleaned. When large dust that cannot be collected by this cleaning cloth is to be collected and removed, the adhesive surface is brought into surface contact with the surface to be cleaned. A user can change from the cleaning cloth surface to the adhesive surface easily by tilting the support arm beyond a predetermined angle from the surface having the pivot.

BRIEF DESCRIPTION OF THE DRAWINGS

The invention is described with reference to the following Figures, in which.

DETAILED DESCRIPTION OF THE INVENTION

Figure 2:
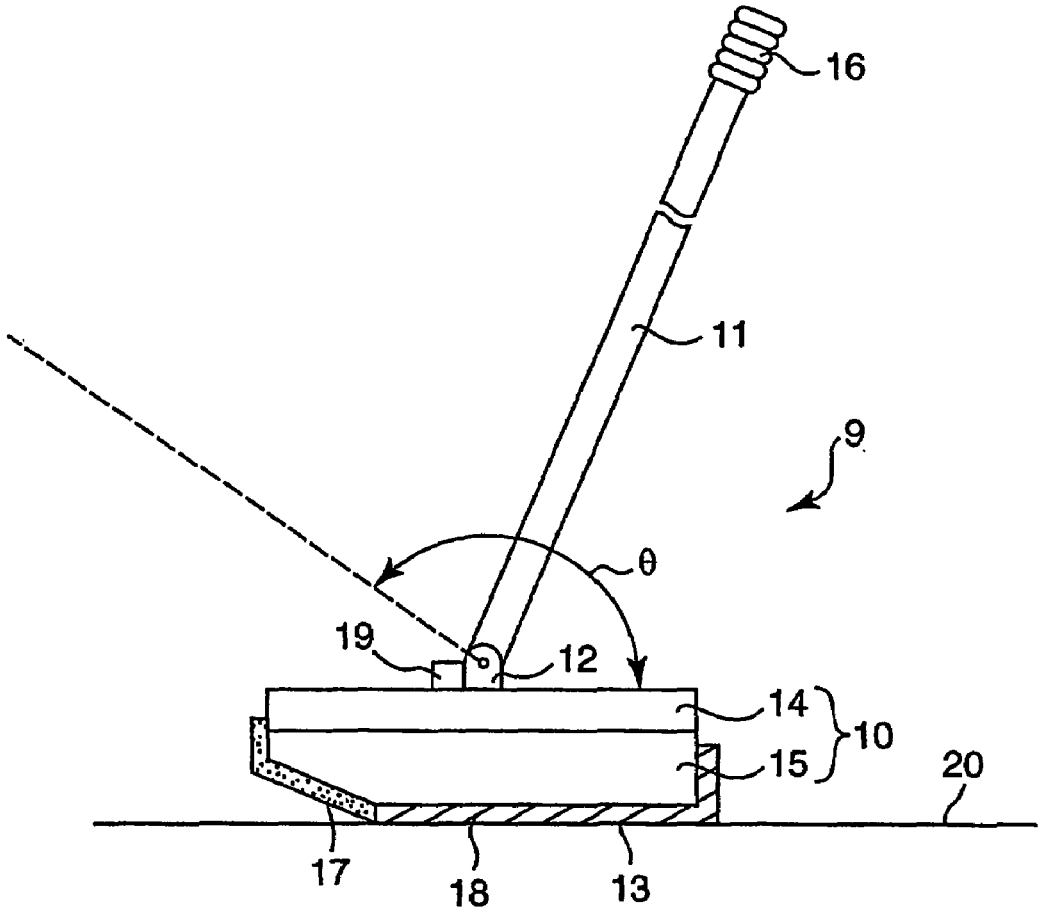
FIG. 2 is a side view when a cleaning cloth surface of a cleaning device according to an embodiment of the present invention is brought into surface contact with a surface to be cleaned.

Hereinafter, the present invention will be explained with reference to the drawings. FIG. 2 is a side view of a cleaning device according to one embodiment of the present invention. The cleaning device 9 shown in FIG. 2 includes a cleaning portion 10 having a cleaning surface 13, a support arm 11 equipped with a handle 16, and a pivot 12 for pivotally supporting the support arm 11 on the surface opposite the cleaning surface 13 of the cleaning portion 10. In the cleaning portion 10, a flexible member 15 is fitted and fixed (preferably by an adhesive) to a holding plate 14, and the cleaning surface 13 is disposed on the bottom surface of this flexible member 15. The cleaning surface 13 comprises an adhesive surface 17 and a cleaning cloth surface 18. A stopper 19 is provided next to the pivot 12 for restricting movement of the support arm 11.

The holding plate 14 is made of a rigid plastic material such as an ABS resin, for example. The flexible member 15 is made of a flexible material such as a rubber or foamed urethane. Besides the non-woven fabric that has been used for cleaning devices in the past, the cleaning cloth 18 can use woven fabrics such as a dust-cloth and a knitted fabric. The adhesive surface 17 must have tackiness to such an extent that it can adhere to the dust or the like having a size exceeding a predetermined size. Therefore, an adhesive is applied to the surface, or an adhesive tape is bonded, to form the adhesive surface 17. These cleaning cloth and adhesive surface are preferably replaceable. Further preferably, they are individually exchangeable.

The support arm 11 is interconnected to the cleaning portion 10 by the pivot 12. Movement of the support arm 11 is restricted by the stopper 19 provided next to the pivot 12 within a predetermined angle θ from the surface having the pivot. In other words, the support arm is freely movable within the range of this angle θ, where the cleaning portion stays parallel to the surface 20 to be cleaned at any angle within this range, so that the cleaning cloth surface 18 keeps surface contact with the surface 20 to be cleaned.

Figure 3:
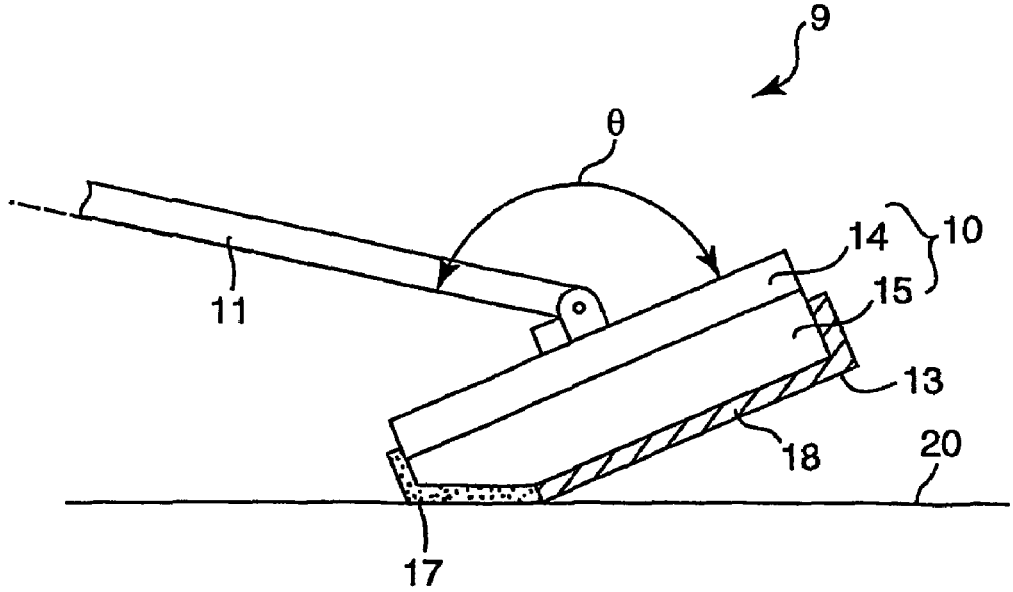
FIG. 3 is a side view when an adhesive surface of the cleaning device according to the present invention is brought into surface contact with the surface to be cleaned.

The support arm 11 can be freely tilted within the range of the angle θ. However, when the support arm 11 is tilted beyond this angle θ, the stopper 19 restricts the movement of the support arm 11, so that the support arm 11 cannot be tilted beyond the angle θ. When the stopper arm 11 is further tilted against the stopper 19, the cleaning portion 10 is tilted as shown in FIG. 3. As a result, the cleaning cloth surface 18 separates from the surface 20 to be cleaned, and the adhesive surface 17 comes instead into surface contact with the surface 20 to be cleaned.

As described above, the cleaning surface 18 can collect fine dust between the fibers and can remove the dust. However, this cleaning cloth surface 18 cannot collect the dust greater than a predetermined size. Therefore, this cleaning cloth surface 18 is used for ordinary cleaning and when the large dust gathered by the cleaning cloth surface 18 is collected, the support arm is tilted so that the adhesive surface 17 can be brought into surface contact with the surface 20 to be cleaned and the large dust is caused to adhere to the adhesive surface and is removed.

Switching between the cleaning cloth surface 18 and the adhesive surface 17 can be easily made during the cleaning operation by merely changing the tilt angle of the support arm. While the cleaning cloth surface 18 keeps surface contact with the surface to be cleaned, the adhesive surface is out of surface contact with the surface to be cleaned. Therefore, the cleaning cloth surface can freely come into sliding contact with the surface to be cleaned and its movement is not impeded.

Figure 4:
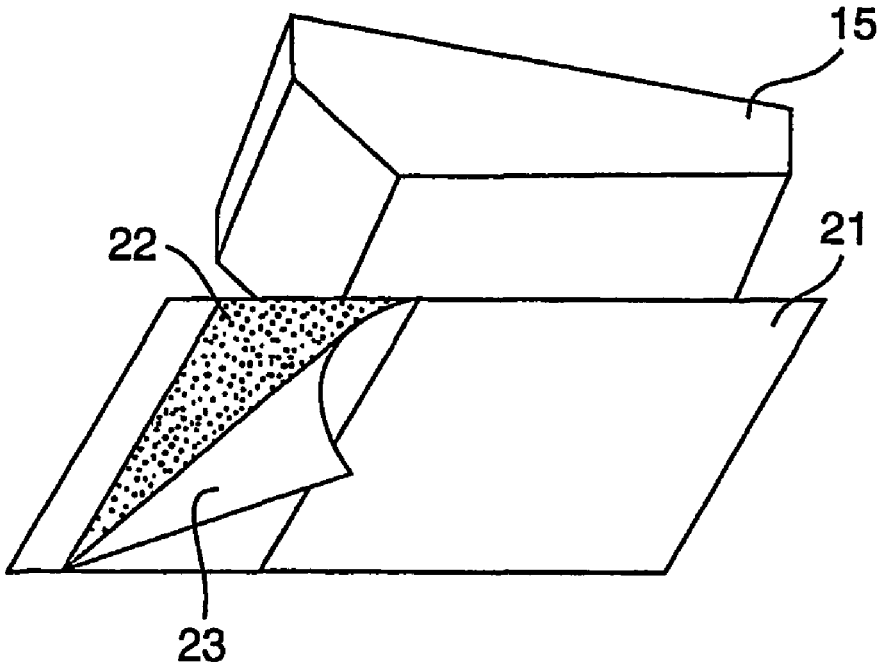
FIG. 4 is a perspective view showing the construction of the adhesive surface and the cleaning cloth surface.

As shown in FIG. 4, for example, the cleaning cloth surface and the adhesive surface have a unitary structure, in which the adhesive 22 may be applied to a predetermined position of the non-woven fabric 21, and may be affixed to the cleaning portion so that the adhesive surface and the cleaning cloth surface can be arranged to a predetermined position of the bottom surface of the flexible member 15 when held by the cleaning portion 10. According to such a structure, the adhesive surface and the cleaning cloth surface are exchangeable. This adhesive portion 22 may be covered with a peelable protective sheet 23, in such case the adhesive surface can be formed by peeling the protective sheet at the time of use. When the non-woven fabric and the like applied with this adhesive layer has a laminate structure, the cleaning effect can be maintained for a longer time by peeling the outermost layer when the adhesive/cleaning effects drop.

Figure 5:
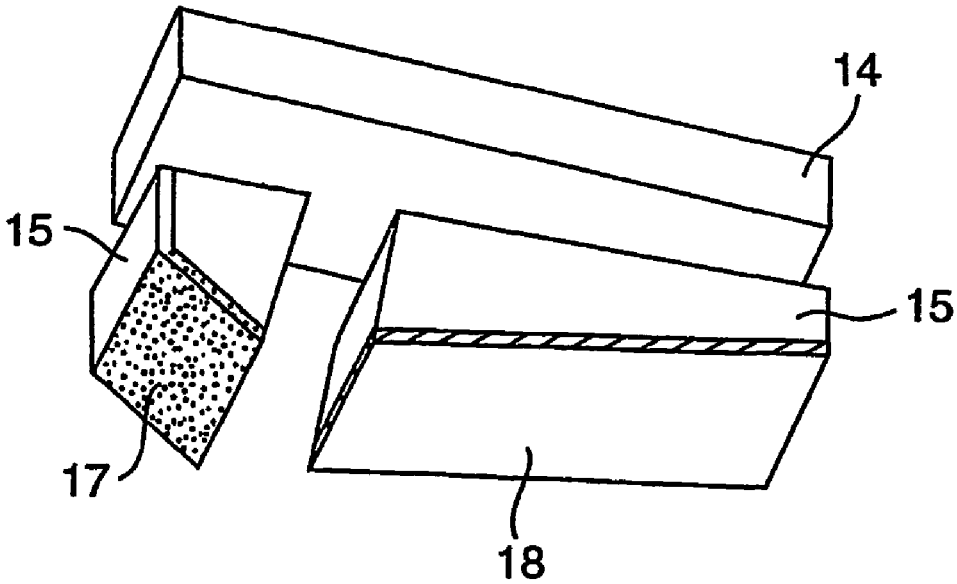
FIG. 5 is a perspective view showing another construction of the adhesive surface and the cleaning cloth surface.

As shown in FIG. 5, it is also possible to constitute the flexible member 15 equipped with the adhesive surface 17 and the flexible member 15 equipped with the cleaning cloth surface 18 by separate members and to fix them to the holding plate 14 so as to form the cleaning cloth surface and the adhesive surface. When the cleaning cloth surface and the adhesive surface are separately constituted in this way, the cleaning cloth surface and the adhesive surface can be exchanged individually, and only the contaminated portion can be exchanged.

EXAMPLES

Example 1

In the cleaning device having the construction shown in FIG. 2, a dust removing sheet commercially available from Kao K. K. under the trade name "Quickie" was fitted to the cleaning cloth surface 18 and an adhesive tape commercially available from Sumitomo 3M Co. under trade name "Sole Mat No. 5900A" was fitted to the adhesive surface 17.

Example 2

In the cleaning device having the construction shown in FIG. 2, a dust removing sheet commercially available from Kao K. K. under the trade name "Quickle" was fitted to the cleaning cloth surface 18, and a dust removing sheet of Kao K. K. under the trade name "Quickle", applied with an adhesive, was fitted to the adhesive surface 17.

Example 3

In the cleaning device having the construction shown in FIG. 2, a dust removing sheet available from Sumitomo 3M Co. under the trade name "Duster Cloth Extra" was fitted to the cleaning cloth surface 18 and a dust removing sheet available from Sumitomo 3M Co. under the trade name "Duster Cloth Extra" applied with an adhesive was applied to the adhesive surface 17.

Comparative Example 1

Figure 1:
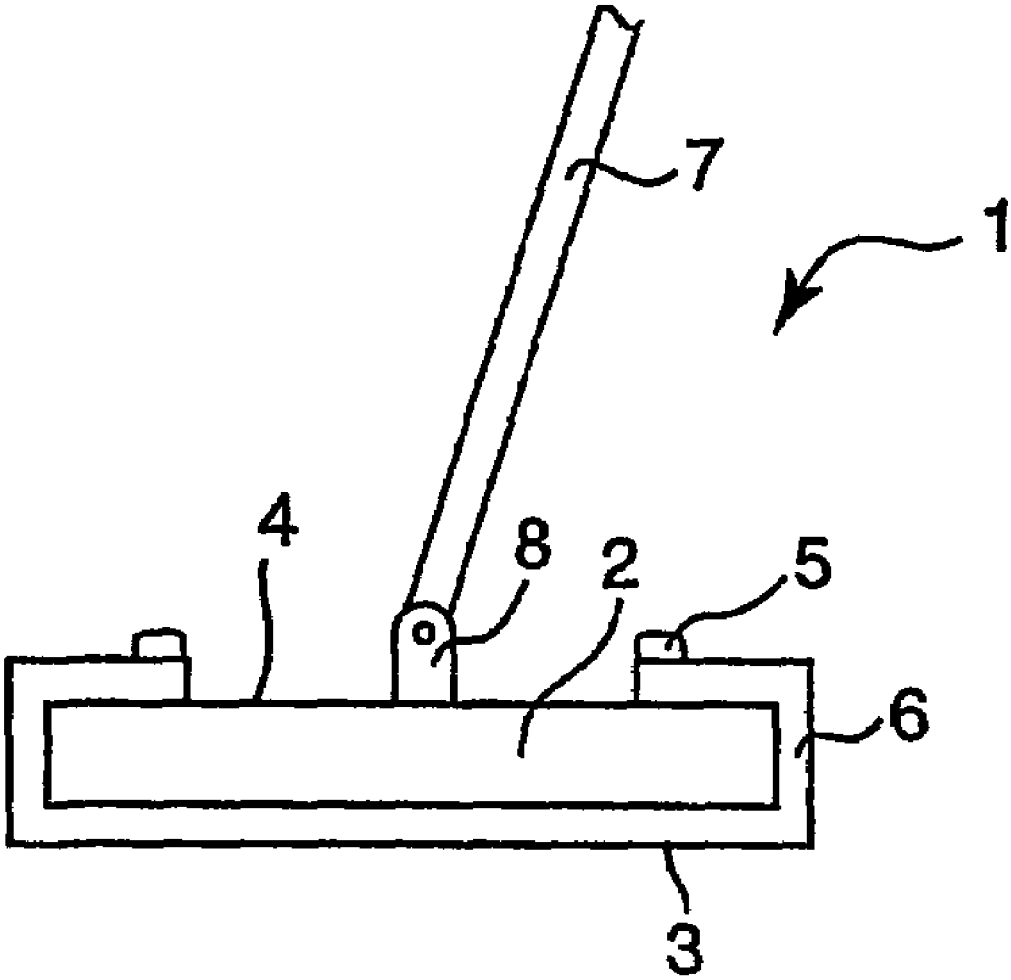
FIG. 1 is a side view of a conventional cleaning device.

A commercially available cleaning device, a product of Kao K. K., having the construction shown in FIG. 1 was used, and a dust-removing sheet commercially available from Kao K. K. under the trade name "Quickle" was fitted as the cleaning cloth 6.

Comparative Example 2

In a cleaning device having the construction shown in FIG. 2, a dust-removing sheet commercially available from Kao K. K. under the trade name "Quickle" was fitted to both cleaning cloth surface 18 and adhesive surface 17.

Evaluation of Cleaning Performance:

On flooring (wooden floor) were scattered as the dust 0.3 g of bread crumbs, 0.2 g of paper pieces and 0.3 g of cotton dust. While the cleaning cloth surface was brought into surface contact with the flooring, the cleaning cloth surface of each of the cleaning devices produced by Examples and Comparative Examples was passed once on the dust. Then, while the support arm was tilted, the adhesive surface was brought into surface contact with the flooring and the dust was collected. The dust collection operation by this adhesive surface was carried out three times. Next, the weight of the dust adhering to the cleaning cloth surface and to the adhesive surface was measured, and the dust adsorption ratio was calculated by the following equation to evaluate cleaning performance. Incidentally, because the cleaning device of Comparative Example 1 was not equipped with the adhesive surface, the dust collecting operation by the adhesive layer was not conducted.

Expression 1 :

$$\text{dust collection ratio}(\%) = \frac{\text{(dust amount(g) adhering to cleaning cloth surface and to adhesive surface)}}{\text{(scattered amount of dust on floor)}} \times 100$$

Figure 6:
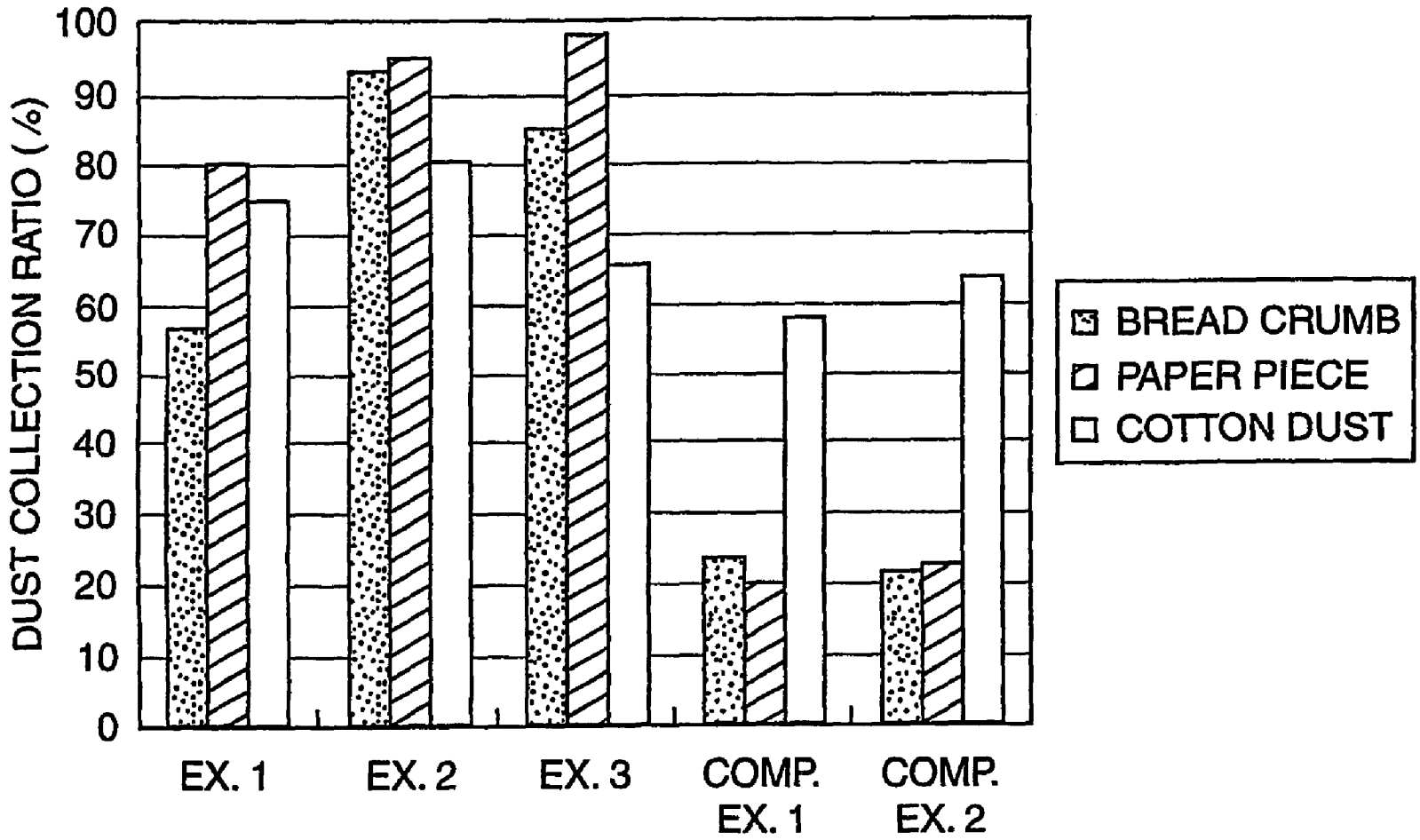
FIG. 6 is a graph showing the results of cleaning performance evaluations.

The result of evaluation of cleaning performance is shown in Table 1 and FIG. 6.

TABLE 1

| Cleaning Performance | | | |
|---|---|---|---|
| Example No. | bread crumb | paper piece | cotton dust |
| Ex. 1 | 56.7 | 80 | 75 |
| Ex. 2 | 93.3 | 95 | 80 |
| Ex. 3 | 85 | 97.5 | 65 |
| Comp. Ex. 1 | 23.3 | 20 | 58.3 |
| Comp. Ex. 2 | 21.7 | 22.5 | 63.3 |

It could be seen clearly from the result that the cleaning devices not equipped with the adhesive layer in Comparative Examples 1 and 2 exhibited lower cleaning performance with respect to the dust having large sizes such as bread crumbs and paper pieces than the cleaning devices of Examples 1 to 4, and could not sufficiently collect the dust.

In the cleaning device according to the present invention, the cleaning surface of the cleaning portion comprises the adhesive surface and the cleaning cloth surface individually capable of coming into surface contact with the surface to be cleaned. The cleaning device is generally used while the cleaning cloth surface is kept in surface contact with the surface to be cleaned, and the adhesive surface is brought into surface contact with the surface to be cleaned when a large dust that cannot be collected by the cleaning cloth are collected. Switching of the cleaning cloth surface and the adhesive surface can be easily achieved as the support arm is tilted by a predetermined angle from a surface having a pivot.

The invention claimed is:

1. A cleaning device for cleaning a surface comprising:

a cleaning head having a cleaning surface and a top surface, the cleaning surface including a cleaning cloth surface and a contiguous adhesive surface arranged at an angle relative to the cleaning cloth surface;

a support arm pivotally connected with the cleaning head top surface; and a stop mechanism arranged to restrict the pivotal movement of the support arm relative to the cleaning head, thereby defining a free range of movement in which the support arm is able to pivot with respect to the cleaning head in a manner that allows the cleaning surface to remain in contact with the surface to be cleaned, and a restricted condition in which the support arm is urged into contact with the stop mechanism, thereby allowing a user to tilt the cleaning head until the adhesive surface contacts the surface to be cleaned.

2. The cleaning device of claim 1, wherein the adhesive surface and the cleaning cloth surface have a unitary structure.

3. The cleaning device of claim 1, wherein the adhesive surface and the cleaning cloth surface are replaceable over the cleaning bead.

4. The cleaning device of claim 1, wherein the adhesive surface and the cleaning cloth surface are individually replaceable over the cleaning head.

5. The cleaning device of claim 1, wherein the cleaning surface is attachable by an adhesive layer disposed on a back side of the cleaning surface to a flexible member of the cleaning device.

6. The cleaning device of claim 1, wherein the cleaning cloth surface is a major portion of the cleaning surface, and the adhesive surface is a minor portion of the cleaning surface.

7. The cleaning device of claim 1, wherein the included angle between the cleaning cloth surface and the adhesive surface is between 90 and 180 degrees.

* * * * *

UNITED STATES PATENT AND TRADEMARK OFFICE

CERTIFICATE OF CORRECTION

PATENT NO. : 7,047,586 B2
APPLICATION NO. : 10/433167
DATED : May 23, 2006
INVENTOR(S) : Shimada, Hiroshi It is certified that error appears in the above-identified patent and that said Letters Patent is hereby corrected as shown below:

Column 3 – Line 64 - Delete ""Quickie"" and insert - - "Quickle" - -, therefor.

Column 6 – Line 19 In Claim 3, delete "bead." and insert - - head. - -, therefor.

Signed and Sealed this

Twenty-second Day of August, 2006

JON W. DUDAS
*Director of the United States Patent and Trademark Office*